US007036533B2

(12) United States Patent
Eckhardt

(10) Patent No.: US 7,036,533 B2
(45) Date of Patent: May 2, 2006

(54) WOVEN FABRIC BELT DEVICE

(75) Inventor: Gerhard Eckhardt, Schottwien (AT)

(73) Assignee: Huyck Austria GES.M.B., Gloggnitz (AT)

( * ) Notice: Subject to any disclaimer, the term of this patent is extended or adjusted under 35 U.S.C. 154(b) by 157 days.

(21) Appl. No.: 10/190,893

(22) Filed: Jul. 8, 2002

(65) Prior Publication Data

US 2004/0003863 A1 Jan. 8, 2004

(30) Foreign Application Priority Data

Jul. 5, 2002 (AT) ..... A 1010/2002

(51) Int. Cl.
*D03D 13/00* (2006.01)

(52) U.S. Cl. ..... 139/383 A; 139/383 AA; 139/383 R; 162/358.2; 162/900

(58) Field of Classification Search ..... 139/383 R, 139/383 A, 383 AA; 162/358.2, 900
See application file for complete search history.

(56) References Cited

U.S. PATENT DOCUMENTS 4,103,717 A * 8/1978 Clark ..... 139/383 A
4,415,625 A * 11/1983 Borel ..... 428/222
4,438,788 A * 3/1984 Harwood ..... 139/383 AA
5,092,373 A * 3/1992 Lee ..... 139/383 AA
5,117,865 A * 6/1992 Lee ..... 139/383 A
5,343,896 A * 9/1994 Schroder et al. ..... 139/383 A
5,411,062 A * 5/1995 Lee ..... 139/383 AA
5,458,161 A * 10/1995 Scarfe ..... 139/383 AA
5,503,196 A * 4/1996 Josef et al. ..... 139/383 A
5,791,383 A * 8/1998 Eckhardt ..... 139/383 AA
RE35,966 E * 11/1998 Lee ..... 139/383 AA
5,915,422 A * 6/1999 Fagerholm ..... 139/383 AA
6,302,155 B1 * 10/2001 Rydin ..... 139/383 AA
6,450,213 B1 * 9/2002 Gauthier et al. ..... 139/383 AA
6,491,794 B1 * 12/2002 Davenport ..... 162/358.2

FOREIGN PATENT DOCUMENTS

WO WO 49223 A1 * 8/2000

* cited by examiner

*Primary Examiner*—John J. Calvert
*Assistant Examiner*—Robert H Muromoto
(74) *Attorney, Agent, or Firm*—Thomas R. Vigil; Welsh & Katz, Ltd.

(57) ABSTRACT

The woven fabric belt device includes a connecting device (7*a*'; 7*b*') located at at least one end of the woven fabric belt (20', 21'). The connecting device is connectable to another connecting device (7*b*'; 7*a*') of the same belt or of another one through a detachable connecting means (9'). A number of certain longitudinal yarns (2', 2") are removed or extend from the fabric (20') along a section (4', 4") assigned to the end of the woven fabric belt. According to the teachings of the invention, the removed or extending sections (4', 4") of the longitudinal yarns (2', 2") are arranged so as to rest on at least one side of the woven fabric belt (20', 21') in a region located in front of the connecting device (7*a*'; 7*b*') so that a support (10'; 10") for protecting the connecting devices (7*a*'; 7*b*') Is provided when the woven fabric belt travels over a working area (AF).

17 Claims, 3 Drawing Sheets

WOVEN FABRIC BELT DEVICE

BACKGROUND OF THE INVENTION

1. Field of the Invention

The present invention relates to a woven fabric belt device, e.g., an endless screen belt for paper and pulp machines, a connecting device being provided at at least one end of the woven fabric belt, said connecting device being connectable to another connecting device of the same belt or of another one through a detachable connecting means, a number of certain longitudinal yarns being removed from the fabric along a section assigned to the end of the woven fabric belt.

2. Description of the Prior Art

Detachable connections between the two front ends of a woven fabric belt or between the ends of two different woven fabric belts such as, for example, conveying belts, endless screen belts or the like, are well known and are described in DE 28 10 72 C, DE 2 059 021 A, DE 2 338 263 A, FR 2 145 365 A and EP 564 436 A for example. The connecting devices for these detachable connections are configured to form individual coupling rings, screw helices or seaming loops. The coupling rings or screw helixes can be sewn to the end of the woven fabric or woven into it, whereas seaming loops may be formed either by the very structure of the woven fabric or by weaving individual longitudinal yarns back into the woven fabric in a weave conforming manner. Suitable joining members are pin wires which, after joining the connection devices together, are threaded through the rings, screw helixes or seaming loops of said connection devices. The pin wire can be straight-lined or spiral-shaped and have a round or oval cross-section.

The connecting devices of many of the known woven fabric joints suffer from wear, which may affect the durability of the belt, more specifically when the woven fabric joint is subjected to high mechanical load or to increased dirt counts. To protect a detachable connection of the type mentioned herein above, FR 2 145 365 A suggests to provide the connection devices with a flat cover fastened to one end of the woven fabric. Although such a cover protects the joint, it also has disadvantages, one of them being that the cost of production increases as a result thereof and another that the woven fabric belt is thicker at the junction so that it is possibly not suited for certain purposes of utilization or is at least subjected to increased wear which in turn reduces the durability of the woven fabric belt.

AT 402 516 describes a woven fabric belt device of the type mentioned herein above that overcomes the above drawbacks. A number of certain longitudinal yarns is thereby removed from the fabric along a section assigned to the end of the woven fabric belt and the removed sections of these longitudinal yarns are arranged, at least in sections, above and/or underneath the connecting device of the woven fabric belt so as to rest thereon, thus forming a protective layer for this connecting device.

The disadvantage of this device is that, when the woven fabric belt device is used under certain conditions, one or several longitudinal yarns are lifted from the woven fabric belt and bent. The yarns may thereby be threaded into the connecting device, damaging the latter as a result thereof.

BRIEF SUMMARY OF THE INVENTION

It is an object of the invention to provide a woven fabric belt device that circumvents these problems while still providing good protection for the connecting device.

The solution to this object is achieved with a woven fabric belt device of the type mentioned herein above, the removed sections of the longitudinal yarns being arranged, in accordance with the invention, so as to rest on at least one side of the woven fabric belt in a region located in front of the connecting device so that a support (10'; 10") protecting the connecting devices (*7a'*; *7b'*) is provided when the woven fabric belt travels over a working area (AF).

A kind of "swelling" is thus achieved in the region located in front of a connecting device, said swelling preventing contact between the connecting device and the working area when the woven fabric belt travels over a working area, thus preventing said connecting device from being damaged.

The removed yarns thereby form said support—the yarns thereby forming the boundary of a usually imaginary "supporting surface area", so that the term "supporting surface area" will be mentioned herein after as a synonym for support—in a "region" located at least in front of a connecting device, but may of course also form a swelling in both regions. It is particularly advisable to arrange the longitudinal threads in a non-overlapping relationship with the connecting device, i.e., so that they do not extend into the region of the connecting device. In that the yarns are not extending beyond the connecting device, they cannot be bent thereinto and cannot damage it as a result thereof.

There may be provided that the region of the supporting surface area reaches to the immediate proximity of the connecting device but it may also end at a distance in front of the connecting device. The extension of the region thereby depends on the expected strain when in use, on the purpose of utilization, the working area, and so on, as well as on the thickness of the supporting surface area. As a rule however, it will be indicated to bring the supporting surface area into the nearest possible proximity with the connecting device in order to provide best protection without affecting the running properties of the woven fabric belt over the working area.

The supporting surface area may be of a particularly stable configuration when the removed sections of the longitudinal yarns are woven around transverse yarns and are woven back together with these.

Furthermore, the stability of the woven fabric belt device, and its durability as a result thereof, may be increased by weaving the longitudinal yarns back into the woven fabric belt in a region adjacent the region of the transverse yarns.

Production is easy when the transverse yarns are arranged in the region in front of the supporting surface area on a side of the woven fabric belt facing the working area. More specifically when the transverse yarns are comprised of two or more layers, this permits to increase the thickness of the supporting surface area.

The connection between the supporting surface area and the woven fabric belt is particularly good when at least the transverse yarn nearest the connecting device is interwoven with the woven fabric belt.

In a concrete embodiment of the invention, the longitudinal yarns have varied dimensions with regard to the lengths thereof. This may for example be achieved by taking the longitudinal yarns out of the woven fabric belt at various locations—related to the longitudinal direction of the woven fabric belt. This arrangement permits continuous, and not abrupt, "transition" between the woven fabric belt and the supporting surface area over the width of the woven fabric belt device so that the device may travel over the working area in a much more uniform manner.

There may furthermore be provided that the number of removed longitudinal yarns is only assigned to the lateral border region of the woven fabric belt. This provision permits to additionally provide efficient protection of the border region of a connection, which is generally particularly prone to wear.

Particularly good protection may be achieved when the number of removed longitudinal yarns is evenly distributed over the entire width of the woven fabric belt.

In a woven fabric made of plastic threads, it proved particularly advantageous to thermally flatten the removed sections of the longitudinal yarns of the woven fabric by heating them as they are stretched in longitudinal direction, since the longitudinal yarns are normally bent according to the structure of the woven fabric.

A particularly advantageous embodiment is obtained when the connecting device is a row of seaming loops provided at the end of the woven fabric belt or a spiral of a plug-type seam fastened to said end and when the joining member is a seam joining pin wire of a plug-type seam that joins two seaming loops or spirals together. In this embodiment, the rows of seaming loops or the fixation of the seaming spiral to the end of the woven fabric belt are formed by certain longitudinal yarns being removed in sections and by neighboring longitudinal yarns being woven back in sections into the woven fabric in a weave conforming manner, the longitudinal yarns being taken out of the woven fabric, in accordance with the invention, at those locations only at which the neighboring longitudinal yarns are woven back into the woven fabric and the sections of the longitudinal yarns removed are forming the protective layer. In this embodiment, a specific joining technique is made use of in an effort to produce the supporting surface area. For if the connecting devices are rows of seaming loops or seaming spirals fastened to the woven fabric by means of seaming loops, the seaming loops are usually produced in such a manner that certain longitudinal yarns are removed from the woven fabric along a section in order to be capable of weaving neighboring longitudinal yarns back into the woven fabric in a weave conforming manner to thus form one seaming loop each, the removed longitudinal yarns being usually cut at the location at which they leave the woven fabric. In the woven fabric belt device according to the invention, by contrast, the removed yarns form the supporting surface area in the region located in front of the connecting device and need not be cut at the location at which they are taken out of the woven fabric.

BRIEF DESCRIPTION OF THE SEVERAL VIEWS OF THE DRAWINGS

Further advantages and characteristics of a woven fabric belt device in accordance with the invention will become apparent in the following description of an exemplary embodiment of the invention given with reference to the appended drawing in which.

DETAILED DESCRIPTION OF THE INVENTION

Figure 1:
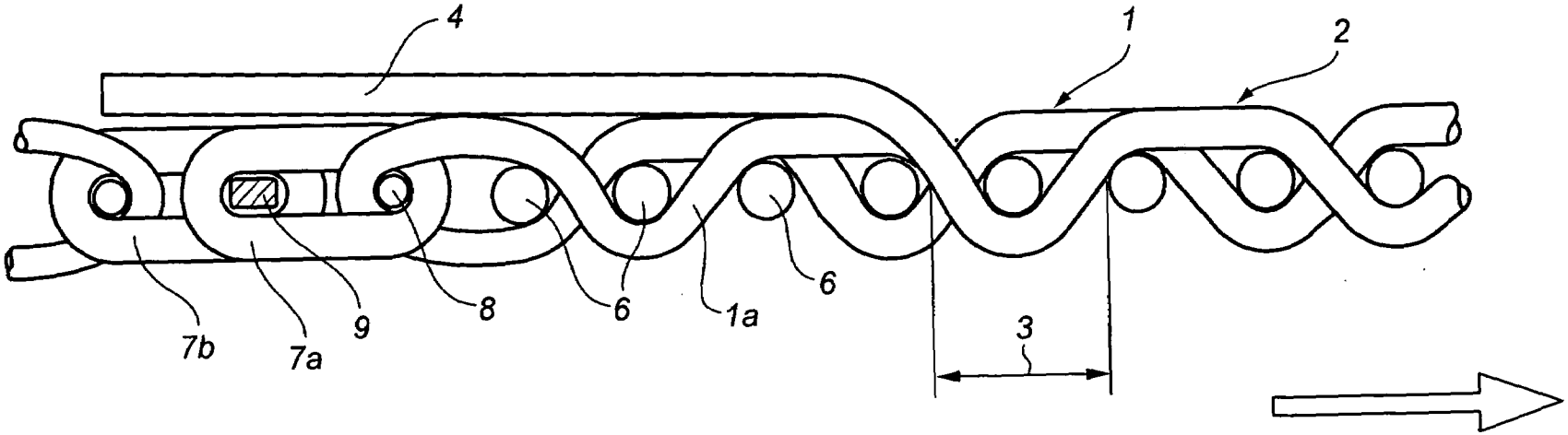
FIG. 1 is a schematic side view of a woven fabric belt device in the region of the detachable connection in the example of an endless screen for current state of the art paper or pulp machines.

It can be surveyed from FIG. 1 that the woven fabric of a state of the art endless screen is made of longitudinal yarns 2 and of transverse yarns 6. To attach a seaming spiral 7*a*, seaming loops are provided at the end of the woven fabric, these loops being produced by weaving back a section 1*a* of the longitudinal yarn 1 into the woven fabric in a weave conforming manner. In order to allow or facilitate this weaving back process, a neighboring longitudinal thread 2 is taken out of the woven fabric along a section 4 thereof. Another seaming spiral 7*b* is attached to the other end of the woven fabric belt in the same or an analogous manner. The spirals 7*a* and 7*b*, which are shaped to have an oval configuration in the embodiment of concern, are laterally insertable into each other and are held together by way of one or multiple (see FIG. 2) pin wires 9 that are threaded in a straight line, parallel to the end of the woven fabric.

In the exemplary embodiment shown, the end of the section 1*a* of longitudinal yarn 1, which has been woven back, extends one transverse yarn 6 further into the woven fabric than the section 4 of longitudinal yarn 2 is taken out thereof, so that, at the area of their intersection 3, a so-called overlay is formed, which provides improved hold of the section 1*a* in the structure of the woven fabric into which it has been woven back. In the exemplary embodiment shown, the junction zone between the seaming loops and the seaming spirals 7*a*, 7*b* is additionally provided with a respective retaining wire 8 oriented substantially parallel to the single or multiple pin wires 9.

In the state of the art shown, the section 4 of the longitudinal yarn is not cut at the location at which it leaves the woven fabric, but is placed over the seaming spirals 7*a*, 7*b* to protect the seam, the end of section 4 being oriented in a direction counter to the direction of travel of the endless screen indicated by an arrow so that the sections 4 need not be fastened any further.

As mentioned herein above, the disadvantage of this arrangement is that, under certain circumstances, the longitudinal yarns 4 are lifted from the woven fabric belt and become entangled in the connecting devices 7*a*, 7*b* which they may damage or destroy.

Figure 2:
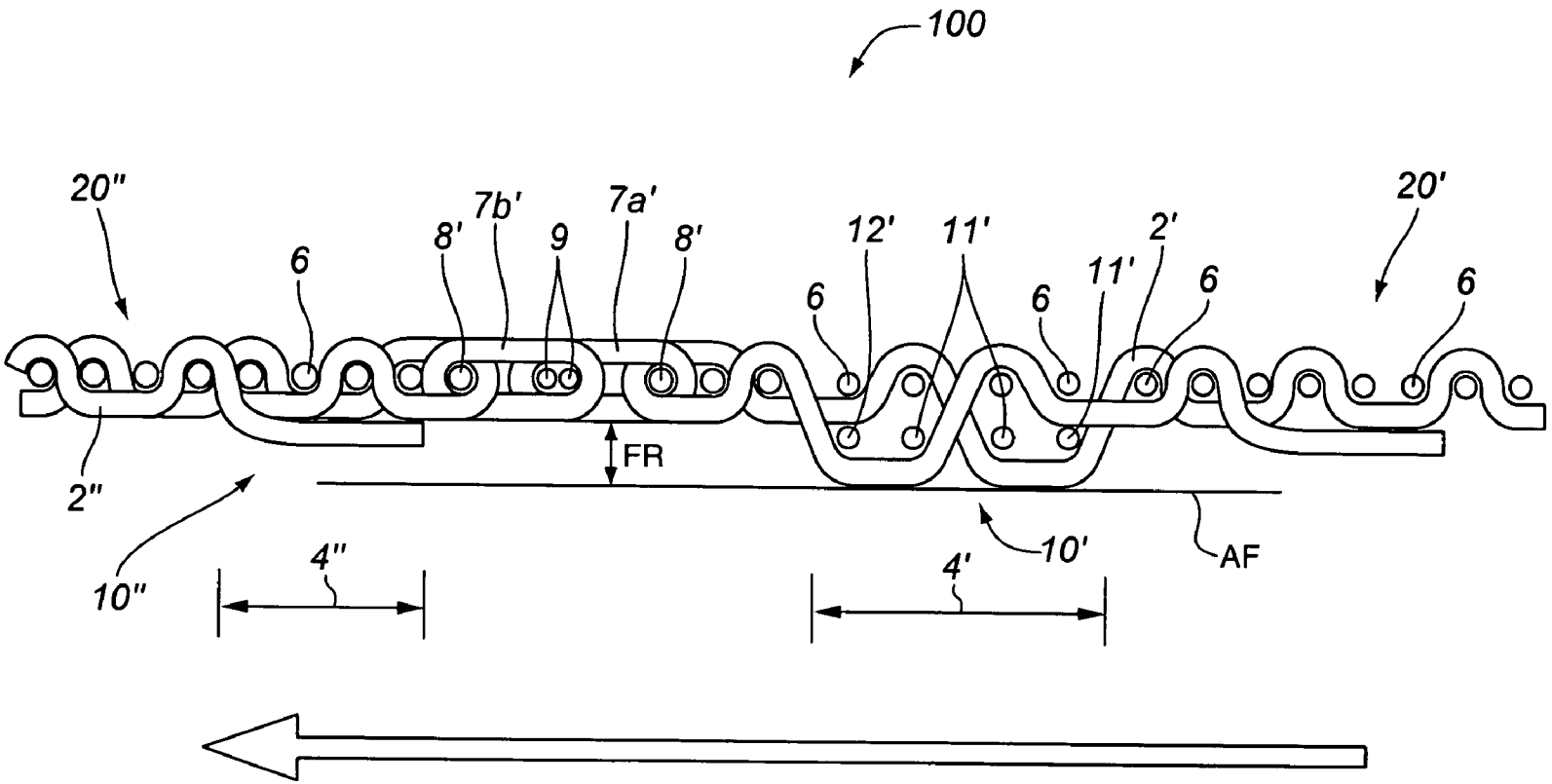
FIG. 2 illustrates a woven fabric belt device with the supports of the invention.
Figure 3:
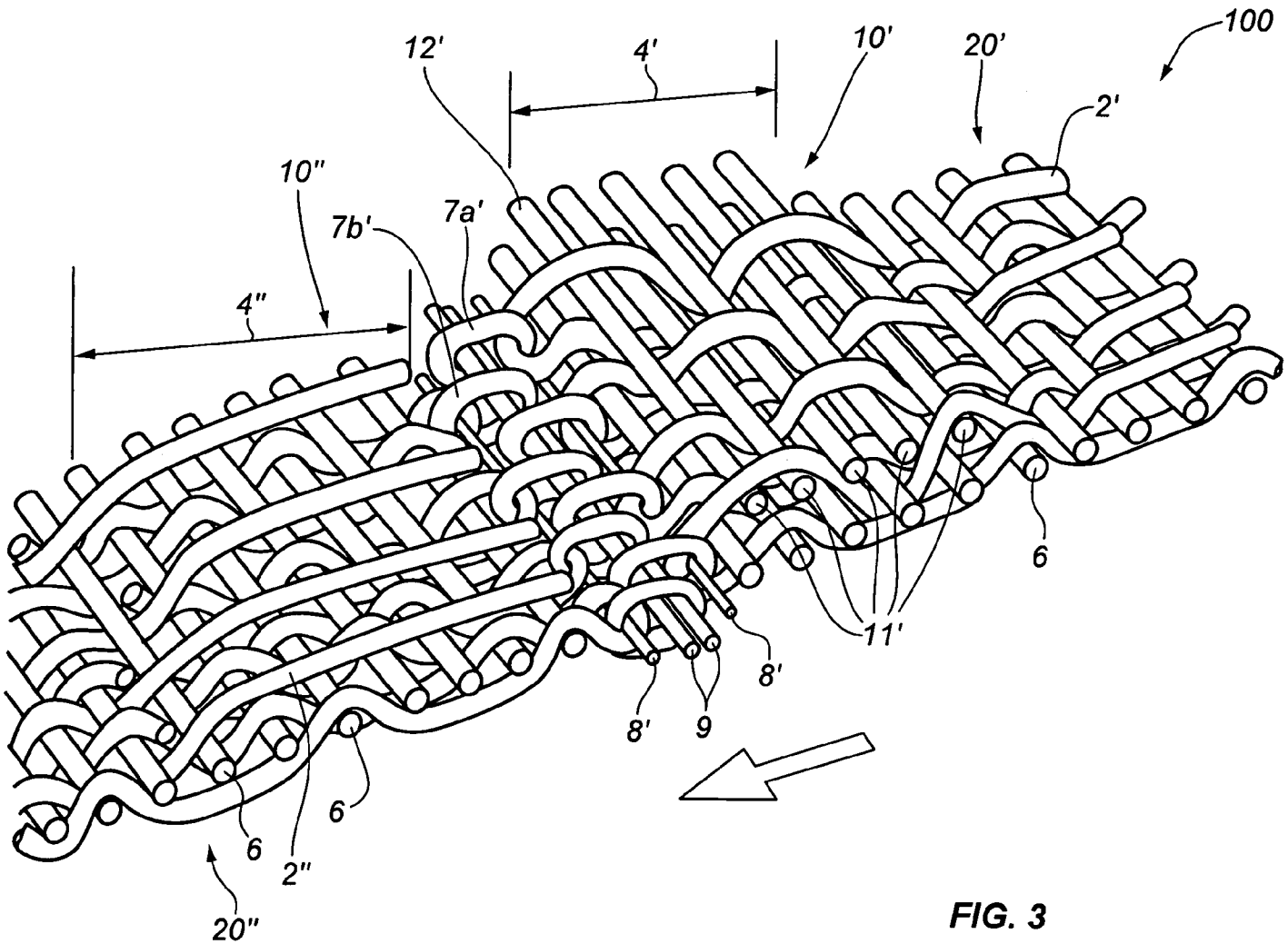
FIG. 3 is a perspective top view of a side of a woven fabric belt device according to the invention with supports.

This can be avoided with a woven fabric belt device of the invention as it is illustrated in the FIGS. 2 and 3. The woven fabric belt 20', 20" shown in FIG. 2 is thereby provided, on the underside thereof, with the supports 10', 10" of the invention that will be discussed later (which is as a rule the side facing a working area), whereas the woven fabric belt according to FIG. 3 is provided with said supports at the top side thereof in the drawing for purposes of clarity.

As can be surveyed from the FIGS. 2 and 3, the removed sections 4', 4" of the yarns 2', 2" only form a support 10', 10" in a region located in front of the connecting device 7*a'*, 7*b'*. As the support 10', 10"—herein after also referred to as supporting surface area or support region—ends directly in front of the connecting device 7*a'*, 7*b'*, or at a certain distance therefrom, the risk is avoided that one of the yarns forming the supporting surface area 10', 10" becomes entangled in the connecting device 7*a'*, 7*b'*.

According to the illustration in FIG. 2, the woven fabric belt device 100 travels over a working area AF such as, for example, a vacuum zone cover on a Chemi-Washer, a straining zone table cover, and so on. In configuring the supports 10', 10" according to the invention, the connecting devices 7*a'*, 7*b'* are placed in a freed position FR relative to the working area AF, i.e., the connecting devices 7*a'*, 7*b'* are not resting on the working area 7*a'*, 7*b'* and cannot be damaged by it, as a result thereof.

In principle, the removed longitudinal yarns 2", which form a bearing area 10", can be cut only in front of the corresponding connecting device 7*b'* adjacent the woven fabric belt 20". A support 10" may be easily produced in this way. Only, the direction of belt travel must then be chosen in such a manner that the open ends of the support are turned away from the direction of movement in order for the yarns not to be bent up, thus damaging the support. The right direction of movement, chosen accordingly, is indicated by an arrow in the FIGS. 2 and 3.

A support 10' is much stabler and, in addition, independent of the direction of travel of the woven fabric belt device when sections 4' of longitudinal yarns 2' removed are woven about transverse yarns 11' and are woven back together with these. A stable and relatively thick supporting surface area 10' is thus obtained. Furthermore, the longitudinal yarns 2' are woven back together with the woven fabric belt in a region adjacent the region with the transverse yarns 11'. When the support 10' is provided at the underside of the woven fabric belt device, the transverse yarns 11' are advantageously also arranged on the underside of the woven fabric belt in the region in front of the connecting device 7*a'* so that the supporting surface area 10' obtained is comparatively high.

With regard to stability, it is furthermore advantageous to have at least the transverse yarn 12' nearest the connecting device 7*a'*, but usually several transverse yarns 11', interwoven with the woven fabric belt.

It is also advantageous when the length 4' of the longitudinal yarns 2' removed have varied dimensions, which may be achieved for example in that the longitudinal yarns are taken out of the woven fabric belt at various locations—related to the longitudinal direction of the woven fabric belt—so that the transition between the woven fabric belt and the supporting surface area 10' is not too abrupt.

The supporting surface areas 10' formed by the removed longitudinal yarns to protect the seam may also be arranged above or on either side of the woven fabric. It is also possible that the removed longitudinal yarns are not evenly distributed over the width of the woven fabric belt but are only assigned to the lateral border of the woven fabric belt in order to achieve wear protection of these lateral border regions.

If the strain put into the woven fabric belt is varying, due for example to a particular configuration of the rolls, the wear protection may only be provided at those locations of the woven fabric junction that are subjected to large amounts of strain.

At the other end of the endless screen, which is assigned to the seaming spiral 7*b'*, the sections 4" of the longitudinal yarns 2" taken out of the woven fabric are cut in front of the connecting device 7*b'* so that, on the one side, they also form a supporting surface area 10" serving to protect the connecting device, but, on the other side, cannot become entangled in the connecting device due to the length of the yarn sections removed. In virtue of the direction of movement (see arrow), it is not absolutely necessary to weave the yarns 4" back.

In principle, there may also be provided, of course, that, at the end of the endless screen assigned to the seaming spiral 7*b'*, a corresponding supporting surface area is formed in the same way as at the end of the seaming spiral 7*a'*, which permits to achieve even better support and protection of the connecting devices 7*a'*, 7*b'*, but there may also be provided—and this provision is also included in the presently claimed invention—that a support is only provided in a region located in front of a connecting device 7*a'*, 7*b'*, i.e., that but one of the supports 10', 10" is provided when it is configured so as to provide sufficient protection of the connecting devices 7*a'*, 7*b'*.

In the embodiment shown, both the woven fabric 20' and the seaming spirals 7*a'*, 7*b'* and the pin wire 9', the transverse yarns 11', 12' and the removed longitudinal yarns 2', 2" are made of a plastic material. As, after their removal, the sections 4', 4" of the longitudinal yarns 2', 2" show so-called crimps, i.e., are bent in a serpentine manner according to the structure of the woven fabric, said sections are pulled flat during thermo-fixation of the seaming loops by heating and stretching them in longitudinal direction.

Depending on the case of application, the length of the region of the supporting surface area 10' can have varied dimensions, typical values amounting to approximately 2C cm. Particular good protection is achieved when the supporting surface area 10' is brought to the immediate proximity of the connecting device 7*a'*, but it may, in principle, also end at a distance in front of the connecting device 7*a'*.

I claim:

1. A woven fabric bell device, a connecting device (7*a'*; 7*b'*) being provided at at least one end of the woven fabric belt (20', 21'), said connecting device being connectable to another connecting device (7*b'*; 7*a'*) of the same belt or of another one through a detachable connecting mechanism (9'), a number of certain longitudinal yarns (2', 2") extending from the fabric (20') along a section (4', 40") assigned to the end of the woven fabric belt, wherein the extending sections (4', 40") of the longitudinal yarns (2', 2') are arranged so as to rest on at least one side of the woven fabric belt (20', 21') in a region located in front of the connecting device (7*a'*; 7*b'*) to form a support (10'; 10") for protecting the connecting devices (7*a'*; 7*b'*) when the woven fabric belt travels over a working area (AF), characterized in that the longitudinal yarns (2', 2") resting on the at least one side of the woven fabric belt (20', 21') are out, so that the yarns (2', 2") have an open end, which open end is directed to the connecting device (7*b'*) or which open end is directed away from the connecting device (7*a'*).

2. The woven fabric belt device according to claim 1, characterized in that the longitudinal threads (2'; 2") are arranged in a non-overlapping relationship with the connecting device (7*a'*; 7*b'*).

3. The woven fabric belt device according to claim 1, characterized in that the region of the support (10', 10") reaches to the immediate proximity of the connecting device (7*a'*; 7*b'*).

4. The woven fabric belt device according to claim 1, characterized in that the region of the supporting surface area (10', 10") ends at a distance in front of the connecting device (7*a'*; 7*b'*).

5. The woven fabric belt device according to claim 1, characterized in that the extending sections (4') of the longitudinal yarns (2') are woven around transverse yarns (11', 12') and are woven back together with these.

6. The woven fabric belt device according to claim 5, characterized in that the longitudinal yarns (2') are woven back into the woven fabric belt in a region adjacent the region of the transverse yarns (11', 12').

7. The woven fabric belt device according to claim 5, characterized in that the transverse yarns (11', 12') are arranged in the region in front of the supporting surface area (7*a'*) on a side of the woven fabric belt facing the working area (AF).

8. The woven fabric belt device according to claim 5, characterized in that the transverse yarns (11', 12') are arranged in two or more layers.

9. The woven fabric belt device according to claim 5, characterized in that at least the transverse yam (12') nearest the connecting device (7*a*') is interwoven with the woven fabric belt (20').

10. The woven fabric belt device according to claim 1, characterized in that the longitudinal yarns (2', 2") have varied dimensions with regard to the extending lengths (4', 4") thereof.

11. The woven fabric belt device according to claim 10, characterized in that the longitudinal yarns (2', 2") extend out of the woven fabric belt (20', 20") at various locations—which are related to the longitudinal direction of the woven fabric belt.

12. The woven fabric belt device according to claim 1, characterized in that the number of extending longitudinal yarns (2', 2") is only assigned to the lateral border region of the woven fabric belt (20', 20").

13. The woven fabric belt device according to claim 1, characterized in that the number of extending longitudinal yarns (2', 2") is evenly distributed over the entire width of the woven fabric belt (20', 20").

14. The woven fabric belt device according to claim 1, the woven fabric (20', 20") of which is made of plastic threads, characterized in that the extending sections (4', 4") of the longitudinal yarns (2', 2") of the woven fabric are thermally flattened by heating them as they are being stretched in longitudinal direction.

15. The woven fabric belt device according to claim 1, characterized in that the connecting device is a row of seaming loops provided at the end of the woven fabric belt or a seaming spiral (7*a*'; 7*b*') of a plug-type seam fastened to said end.

16. The woven fabric belt device according to claim 15, characterized in that the joining member is a seam joining pin wire (9') of a plug-type seam that joins two seaming loops or spirals (7*a*'; 7*b*') together.

17. The woven fabric belt device according to claim 15, in which the rows of seaming loops or the fixation of the seaming spiral (7*a*', 7*b*') to the end of the woven fabric belt are formed by certain longitudinal yarns (2', 2") which extend in sections and by neighboring longitudinal yarns being woven back in sections into the woven fabric (20', 20') in a weave conforming manner, characterized in that the longitudinal yarns (2', 2") extend out of the woven fabric at those locations only at which the neighboring longitudinal yarns are woven back into the woven fabric.

* * * * *

UNITED STATES PATENT AND TRADEMARK OFFICE

CERTIFICATE OF CORRECTION

PATENT NO. : 7,036,533 B2
APPLICATION NO. : 10/190893
DATED : May 2, 2006
INVENTOR(S) : Gerhard Eckhardt It is certified that error appears in the above-identified patent and that said Letters Patent is hereby corrected as shown below:

Claim 9, line 2 “yam” should be --yarn--

Signed and Sealed this

Sixth Day of February, 2007

JON W. DUDAS
*Director of the United States Patent and Trademark Office*

UNITED STATES PATENT AND TRADEMARK OFFICE

CERTIFICATE OF CORRECTION

PATENT NO. : 7,036,533 B2
APPLICATION NO. : 10/190893
DATED : May 2, 2006
INVENTOR(S) : Gerhard Eckhardt It is certified that error appears in the above-identified patent and that said Letters Patent is hereby corrected as shown below:

Col. 7, Claim 9, line 2 “yam” should be --yarn--

Signed and Sealed this

Twentieth Day of February, 2007

JON W. DUDAS
*Director of the United States Patent and Trademark Office*